US012674640B2

(12) United States Patent
Neuman et al.

(10) Patent No.: US 12,674,640 B2
(45) Date of Patent: Jul. 7, 2026

(54) GUN VISE AND METHODS OF USE

(71) Applicant: Gun Vise LLC, Hugo, MN (US)

(72) Inventors: Josiah Neuman, Hugo, MN (US); Jonathan Fettig, North Branch, MN (US)

(73) Assignee: Gun Vise LLC, Hugo, MN (US)

( * ) Notice: Subject to any disclaimer, the term of this patent is extended or adjusted under 35 U.S.C. 154(b) by 0 days.

(21) Appl. No.: 19/091,355

(22) Filed: Mar. 26, 2025

(65) Prior Publication Data

US 2025/0305787 A1 Oct. 2, 2025

Related U.S. Application Data

(60) Provisional application No. 63/639,117, filed on Apr. 26, 2024, provisional application No. 63/570,381, filed on Mar. 27, 2024.

(51) Int. Cl.
*F41A 23/18* (2006.01)

(52) U.S. Cl.
CPC ..... *F41A 23/18* (2013.01)

(58) Field of Classification Search
CPC ..... F41A 23/18
USPC ..... 42/94
See application file for complete search history.

(56) References Cited

U.S. PATENT DOCUMENTS 2,427,365 A * 9/1947 Meister ..... F41A 23/16 269/274
6,761,101 B1 7/2004 Luth
7,356,960 B1 4/2008 Knitt
7,584,690 B2 9/2009 Cauley
8,209,896 B1 7/2012 Cashwell
8,322,068 B2 12/2012 Wilson
8,516,943 B2 8/2013 Rogers
8,578,645 B2 11/2013 Cauley
8,905,391 B2 12/2014 Weissenborn
2012/0222344 A1 9/2012 Werner
2024/0300071 A1* 9/2024 Parris ..... F41G 11/003

FOREIGN PATENT DOCUMENTS

KR 101865535 6/2018

* cited by examiner

*Primary Examiner* — Jonathan C Weber

(74) *Attorney, Agent, or Firm* — MacMillan, Sobanski & Todd, LLC

(57) ABSTRACT

Gun vises are described herein. An example gun vise includes a main body, a shuttle, and an actuator. The main body has a first end, a second end, a main body recess, a first main body shuttle passageway, a second main body shuttle passageway, and a actuator passageway. The shuttle is disposed in the main body recess and is moveable between a shuttle first position and a shuttle second position. The shuttle has a shuttle recess, a first shuttle passageway, a second shuttle passageway, and an actuator recess. The actuator is moveable between an actuator first position and an actuator second position. The actuator has a rod disposed through the actuator passageway and within the actuator recess. Movement of the actuator between the actuator first position and the actuator second position moves the shuttle between the shuttle first position and the shuttle second position.

20 Claims, 7 Drawing Sheets

GUN VISE AND METHODS OF USE

FIELD

The disclosure relates to the field of vises. More specifically, the disclosure relates to a gun vise and methods of use.

BACKGROUND

Gun enthusiasts, gun technicians, and hobbyists often require a stable platform to securely hold guns while performing various tasks such as cleaning, maintenance, repair, sighting, or customization. Traditional methods of supporting guns during these procedures include clamps, bench vises, or makeshift setups using pillows or blocks. However, these methods often lack stability, adjustability, or specific features tailored to the unique needs of gun maintenance.

Currently, gun vises are used to hold a gun during cleaning or maintenance. However, current gun vises have drawbacks, such as not being configured to hold a gun in an upright and upside-down orientation or failing to provide a mechanism for easily maintaining the position of a gun during maintenance.

A need exists, therefore, for improved gun vises and methods of use.

BRIEF SUMMARY OF SELECTED EXAMPLES

Various example gun vises and methods of use are described.

An example gun vise includes a main body, a shuttle, and an actuator. The main body has a first end, a second end, a main body recess, a first main body shuttle passageway, a second main body shuttle passageway, and a actuator passageway. The first main body shuttle passageway extends through the main body and to the main body recess. The second main body shuttle passageway extends through the main body and to the main body recess. The actuator passageway extends from the first end to the main body recess. The shuttle is disposed in the main body recess and is moveable between a shuttle first position and a shuttle second position. The shuttle has a shuttle recess, a first shuttle passageway, a second shuttle passageway, and an actuator recess. The first shuttle passageway has a first central axis that extends within the first main body shuttle passageway. The second shuttle passageway has a second central axis that extends within the main body second shuttle passageway. The actuator is moveable between an actuator first position and an actuator second position. The actuator has a rod disposed through the actuator passageway and within the actuator recess. Movement of the actuator between the actuator first position and the actuator second position moves the shuttle between the shuttle first position and the shuttle second position.

Additional understanding of the gun vises and methods of use described herein can be obtained by reviewing the detailed description of selected examples, below, and the referenced drawings.

DETAILED DESCRIPTION OF SELECTED EXAMPLES

Figure 1:
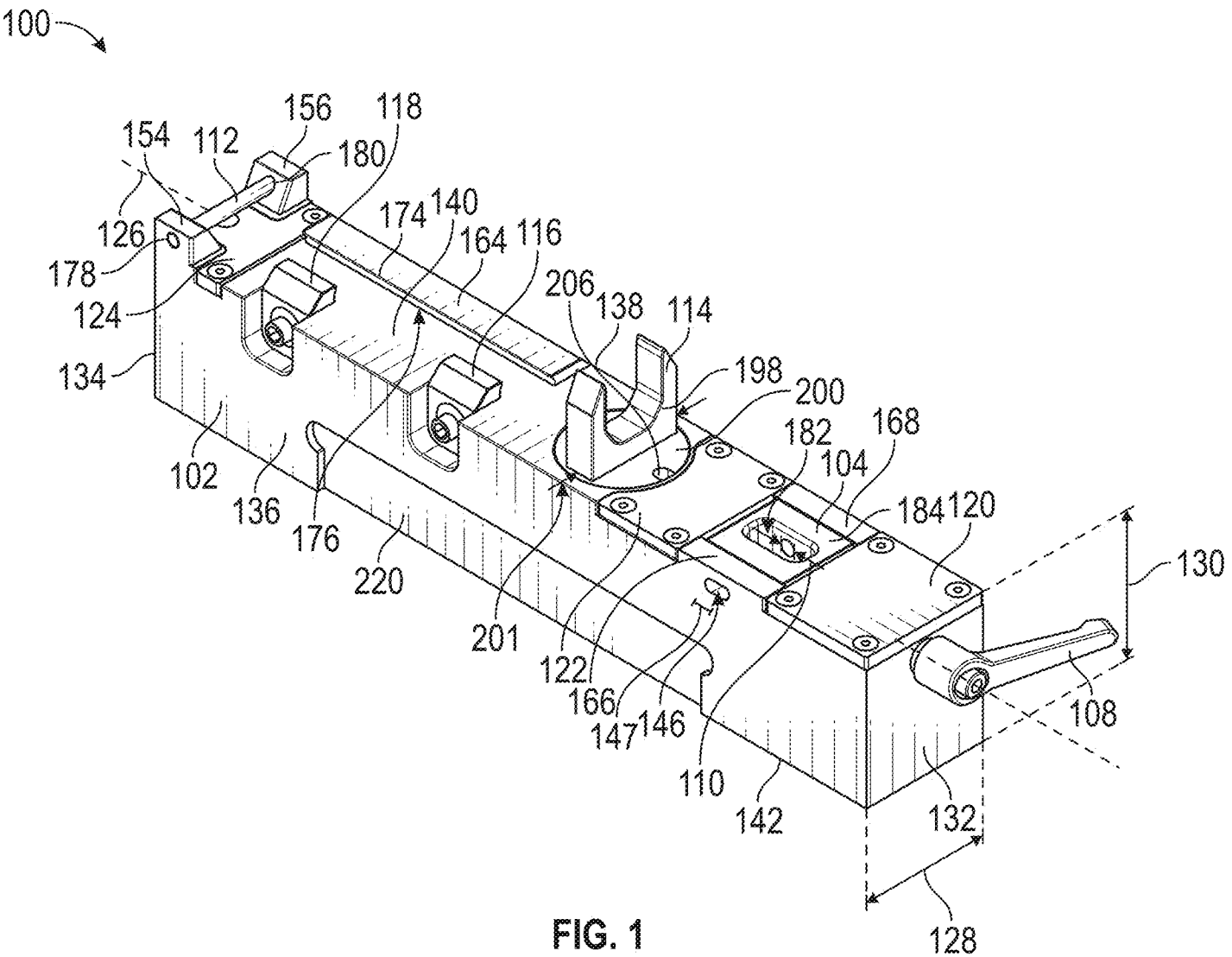
FIG. 1 is a perspective view of an example gun vise.
Figure 2:
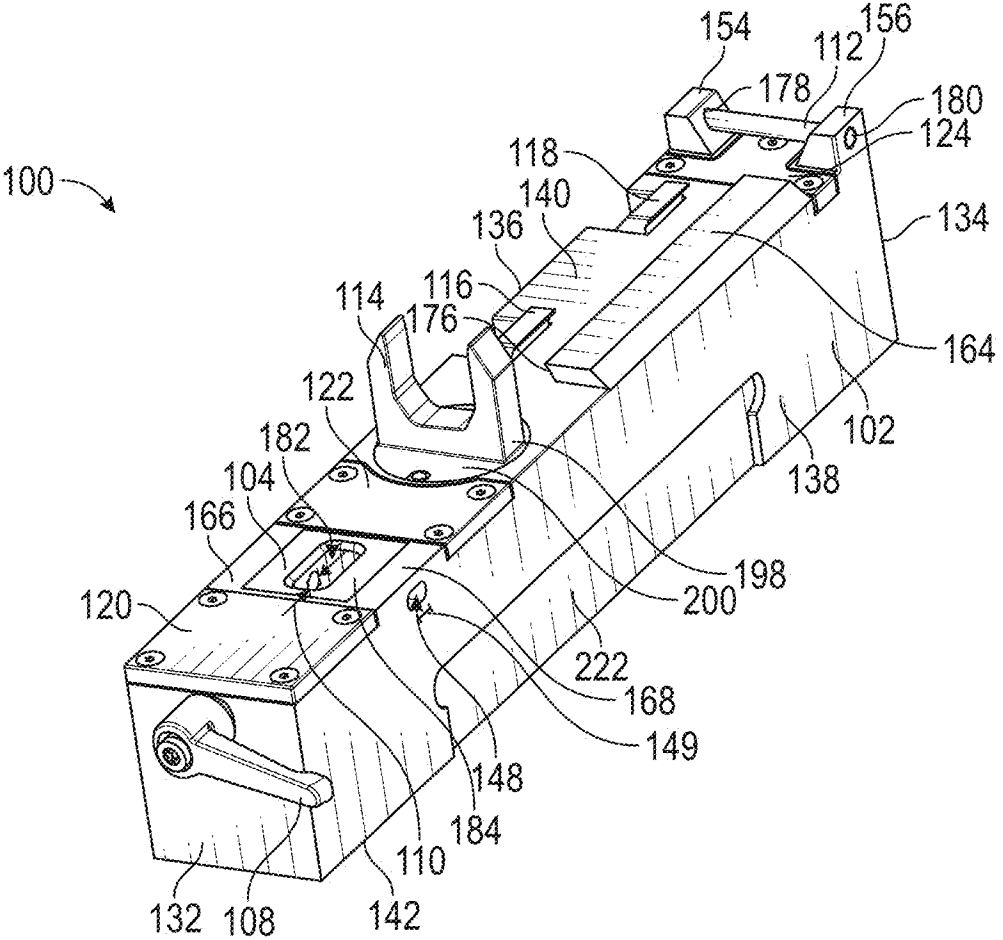
FIG. 2 is another perspective view of the example gun vise shown in FIG. 1.

The following detailed description and the appended drawings describe and illustrate various example gun vises. The description and illustration of these examples enable one skilled in the art to make and use a gun vise. They are not intended to limit the scope of the claims in any manner. The invention is capable of being practiced or carried out in various ways and the examples described and illustrated herein are merely selected examples of the various ways of practicing or carrying out the invention and are not considered exhaustive.

FIGS. 1 through 7 illustrate an example gun vise 100. The gun vise 100 has a main body 102, a shuttle 104, a shuttle spring 106, an actuator 108, a first pin 110, a second pin 112, a barrel slot key 114, a first picatinny rail clamp (e.g., MIL-STD-1913 rail) 116, a second picatinny rail clamp (e.g., MIL-STD-1913 rail) 118, a first cap 120, a second cap 122, and a third cap 124.

The main body 102 has a lengthwise axis 126, a width 128, a height 130, a first end 132, a second end 134, a first side 136, a second side 138, a top 140, a bottom 142, a main body recess 144, a first main body shuttle passageway 146, a second main body shuttle passageway 148, an actuator passageway 150, a plurality of main body recess projections 152, a first receiver projection 154, a second receiver projection 156, a barrel slot key recess 158, a first picatinny rail clamp recess 160, a second picatinny rail clamp recess 162, an elongated rail 164, a first projection 166, and a second projection 168.

The main body 102 extends along the lengthwise axis 126 from the first end 132 to the second end 134. The width 128 of the main body 102 extends from the first side 136 to the second side 138. The height 130 of the main body 102 extends from the bottom 142 to the top 140. The main body recess 144 extends from the top 140 toward the bottom 142. In the illustrated embodiment, the main body recess 144 is illustrated as a rounded rectangular prism; however, the main body recess 144 can be any desired shape including, but not limited to, a sphere, an ovoid, or the like. The first main body shuttle passageway 146 extends through the main body 102 and to the main body recess 144. The first main body shuttle passageway 146 extends from the from the first side 136 to the main body recess 144. The second main body shuttle passageway 148 extends through the main body 102 and to the main body recess 144. The second main body shuttle passageway 148 extends from the second side 138 to the main body recess 144. In the illustrated embodiment, the first main body shuttle passageway 146 extends through the first projection 166 and the second main body shuttle passageway 148 extends through the second projection 168.

In alternative embodiments, the first projection 166 and the second projection 168 can be omitted.

The actuator passageway 150 extends from the first end 132 to the main body recess 144. The plurality of main body recess projections 152 is disposed within the main body recess 144. In the embodiment shown, each main body recess projection of the plurality of main body recess projections 152 is disposed on a sidewall 170 defining a portion of the main body recess 144. Although the gun vise 100 is illustrated as having a plurality of main body recess projections, in alternative embodiments, there may be only one projection or no projections. The first pin 110 is configured to be disposed through the first main body shuttle passageway 146, through a portion of the shuttle 104, through a portion of a gun, and through the second main body shuttle passageway 148. Optionally, the first pin 110 can be a rear lock pin of the gun. The first main body shuttle passageway 146 has a first width 147 and the second main body shuttle passageway 148 has a second width 149. The first width 147 is the same as the second width 149.

The barrel slot key recess 158 is disposed between the main body recess 144 and the second end 134. The barrel slot key recess 158 extends from the top 140 toward the bottom 142. In the illustrated embodiment, the barrel slot key recess 158 has a barrel slot key recess first diameter 157 and a barrel slot key recess second diameter 159. The barrel slot key recess first diameter 157 is greater than the barrel slot key recess second diameter 159. A shoulder 172 is defined at the transition between the barrel slot key recess first diameter 157 and the barrel slot key recess second diameter 159.

The first picatinny rail clamp recess 160 and the second picatinny rail clamp recess 162 extend from the first side 136 of the main body 102, into the main body 102, and toward the second side 138 of the main body 102. Each of the first picatinny rail clamp recess 160 and the second picatinny rail clamp recess 162 is disposed between the barrel slot key recess 158 and the second end 134.

The elongated rail 164 is disposed between the first end 132 and the second end 134 and is aligned relative to the lengthwise axis 126 with the first picatinny rail clamp recess 160 and the second picatinny rail clamp recess 162. The elongated rail 164 includes an elongated rail tapered side 174 that extends from the top 140 and toward the first picatinny rail clamp recess 160 and the second picatinny rail clamp recess 162. The elongated rail tapered side 174 defines an elongated rail recess 176 with the top 140 that, in combination with the first picatinny rail clamp 116 and the second picatinny rail clamp 118, is configured to secure a gun in an up-side down position.

The first receiver projection 154 and the second receiver projection 156 are disposed on the top 140 of the main body 102 at the second end 134 and extend away from the bottom 142. The first receiver projection 154 defines a first receiver projection passageway 178 and the second receiver projection 156 defines a second receiver projection passageway 180. The first receiver projection passageway 178 extends through the first receiver projection 154 and the second receiver projection passageway 180 extends through the second receiver projection 156. The second pin 112 configured to extend through the first receiver projection passageway 178, through a front support of a receiver of a gun, and through the second receiver projection passageway 180. The front support of the receiver of the gun has a crevice that can be disposed on the second pin 112. In alternative embodiments, the front support member of the receiver of the gun has a hole in which the second pin 112 is disposed.

Figure 3:
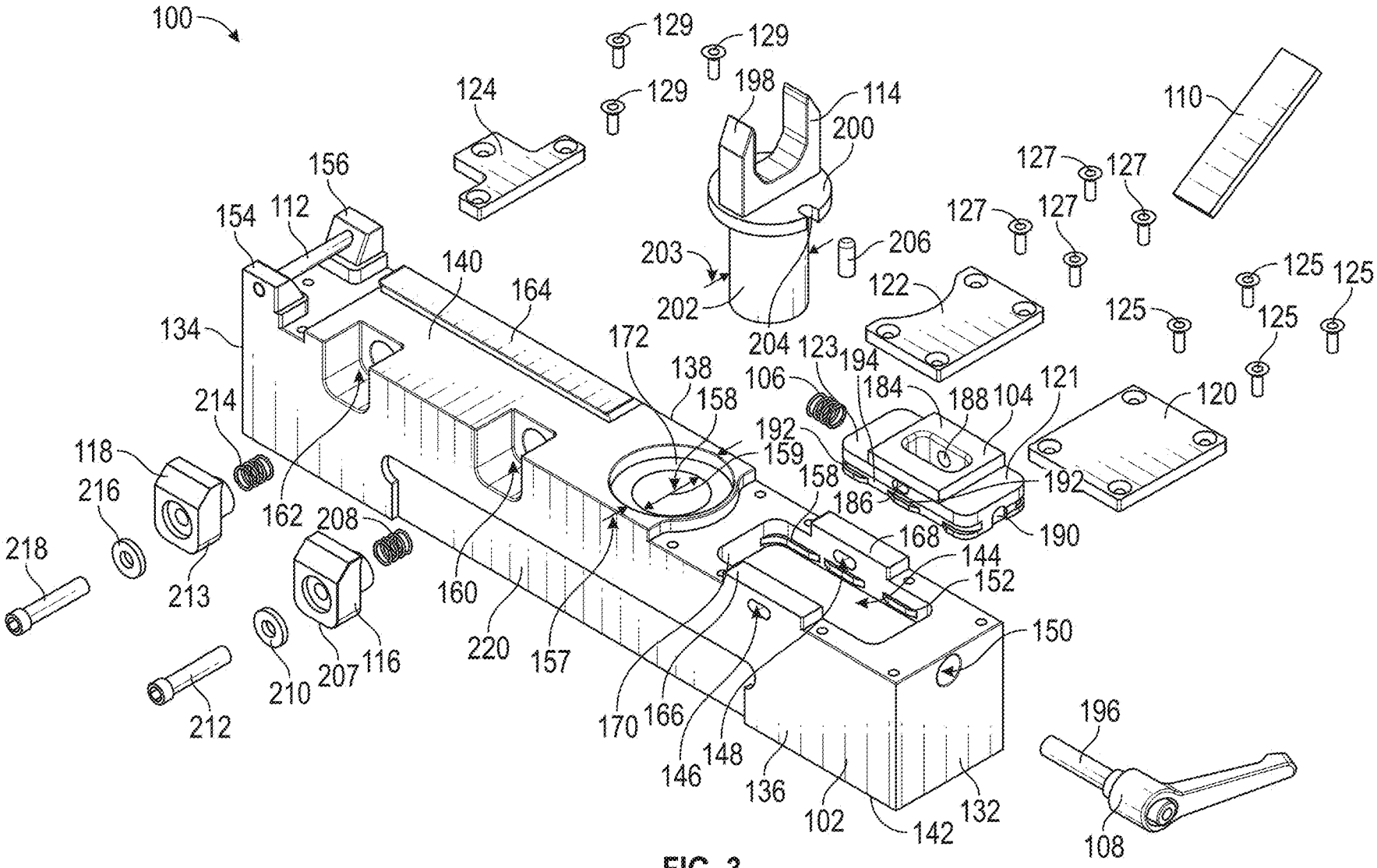
FIG. 3 is an exploded view of the example gun vise shown in FIG. 1.
Figure 4:
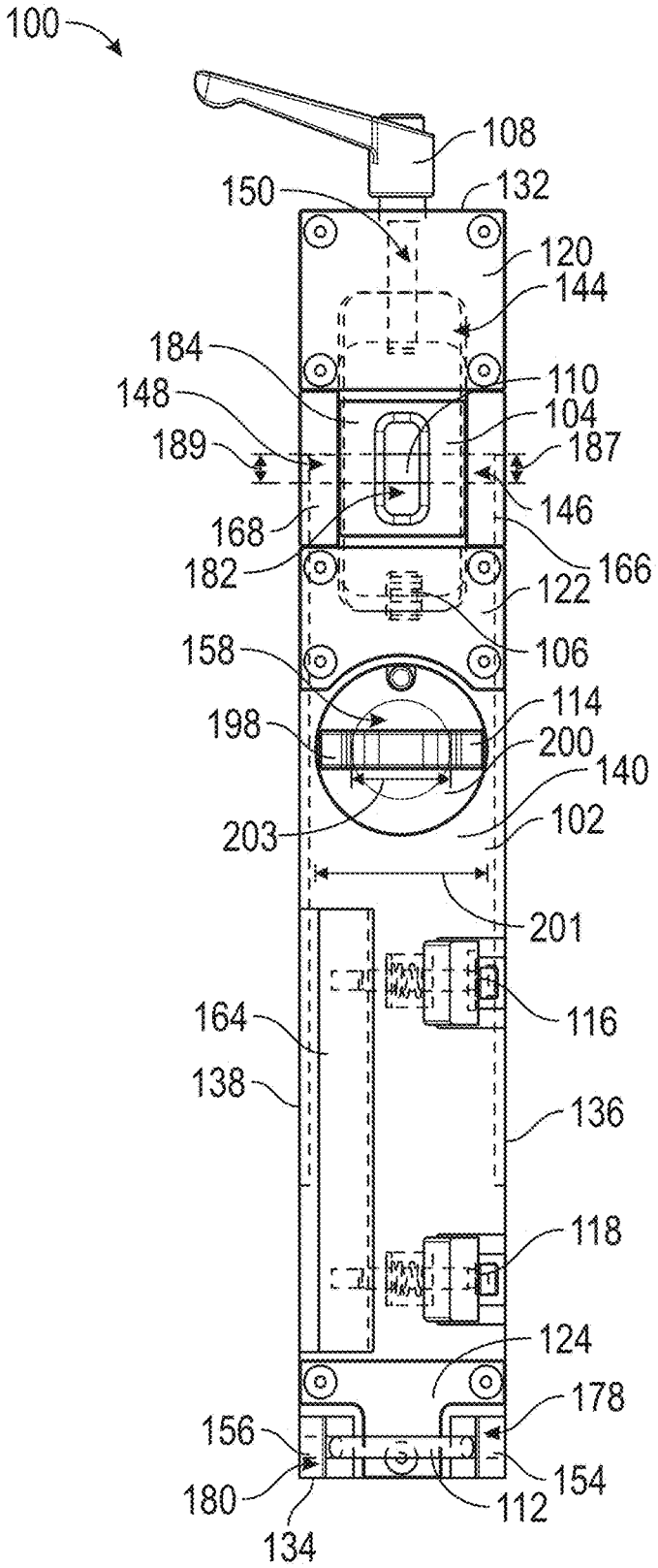
FIG. 4 is a top view of the example gun vise shown in FIG. 1.
Figure 5:
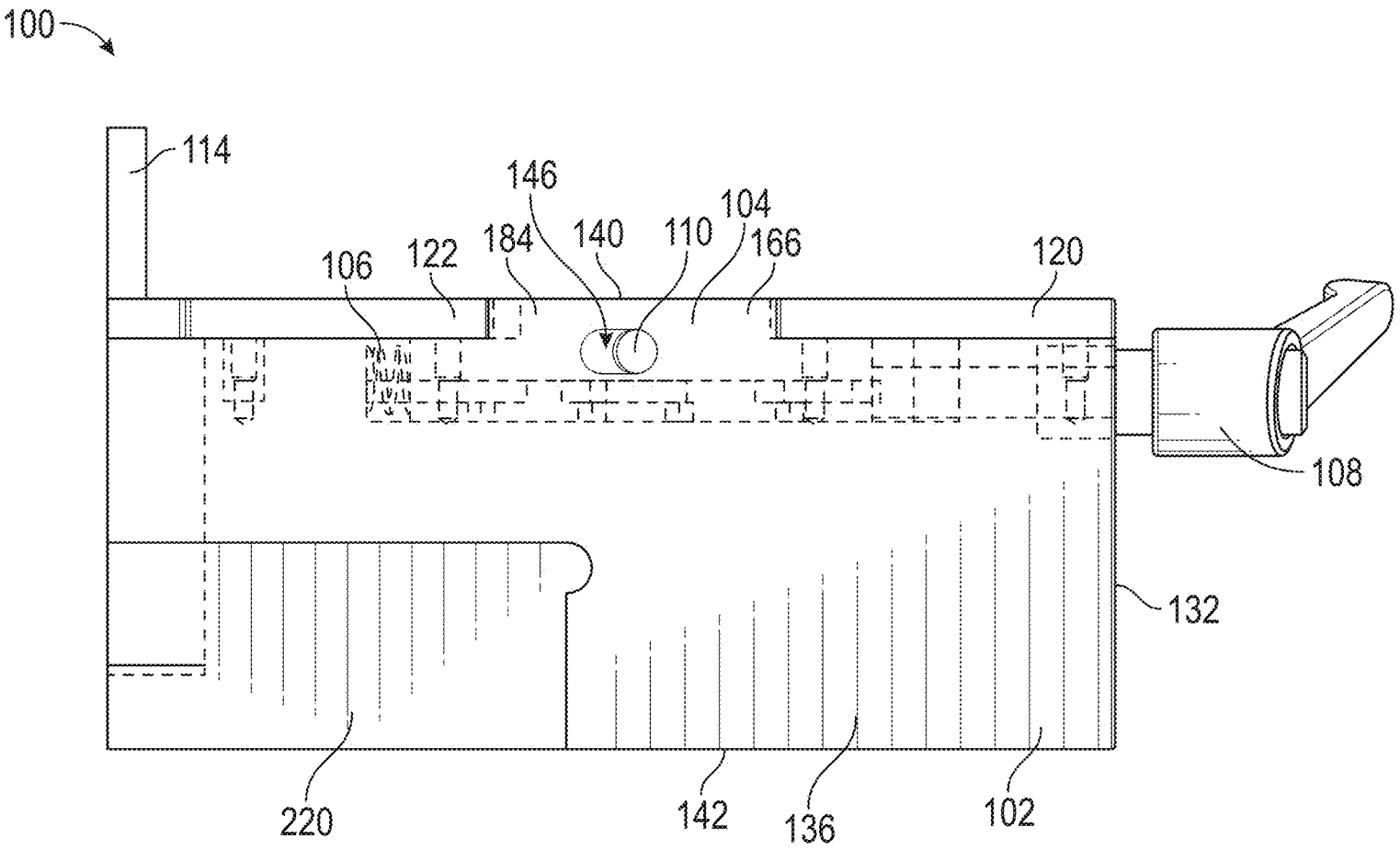
FIG. 5 is a partial side view of the example gun vise shown in FIG. 1.
Figure 6:
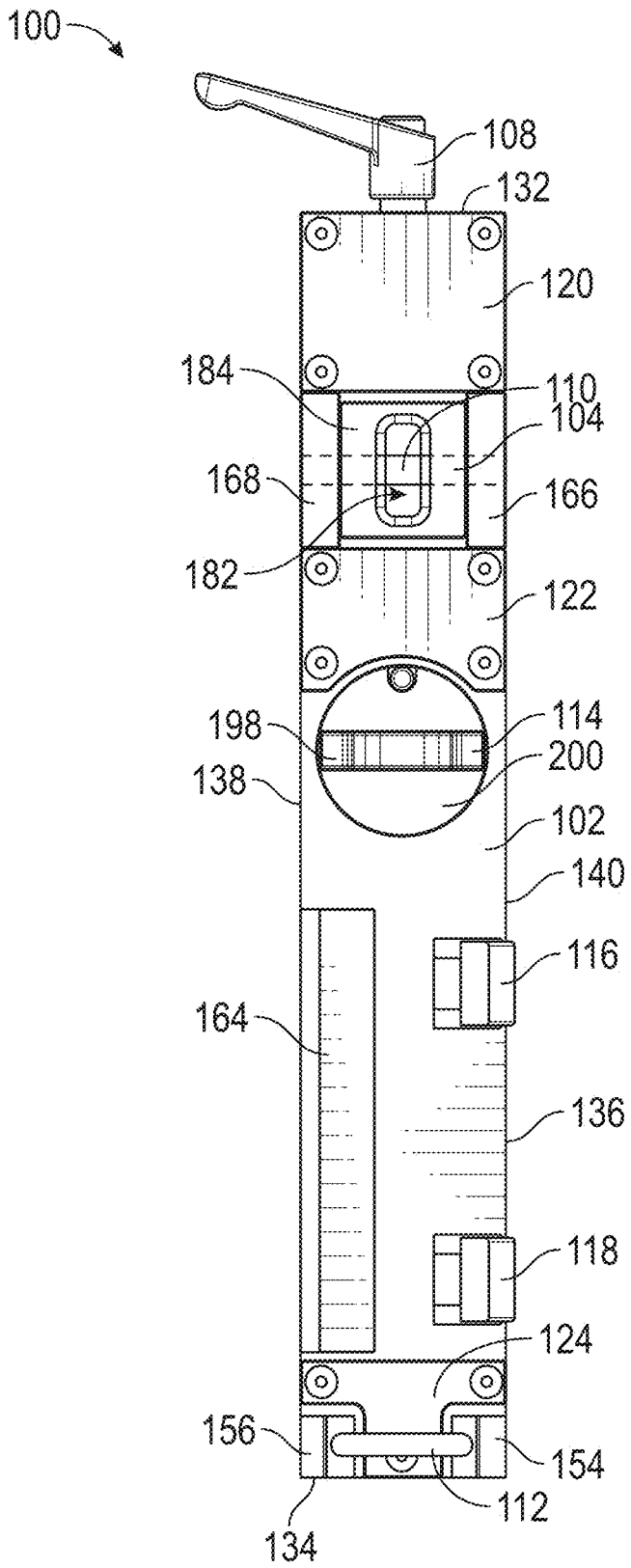
FIG. 6 is a top view of the example gun vise shown in FIG. 1 with the shuttle in a shuttle first position, the first picatinny rail clamp in a first picatinny rail clamp first position, and the second picatinny rail clamp in the second picatinny rail clamp first position.
Figure 7:
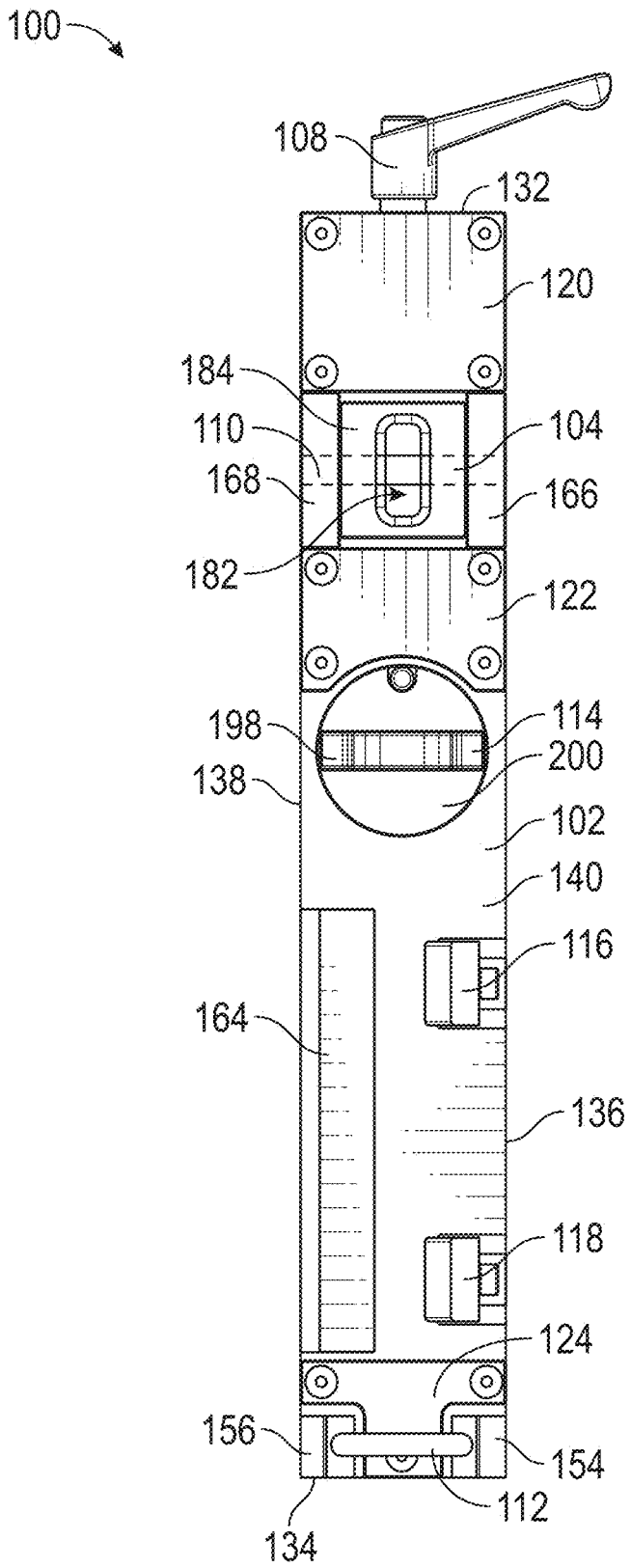
FIG. 7 is a top view of the example gun vise shown in FIG. 1 with the shuttle in a shuttle second position, the first picatinny rail clamp in a second picatinny rail clamp first position, and the second picatinny rail clamp in the second picatinny rail clamp second position.

As shown in FIGS. 1 and 3, the shuttle 104 has a shuttle recess 182, an upper projection 184, a first shuttle passageway 186, a second shuttle passageway 188, an actuator recess 190, and a plurality of shuttle projections 192. The shuttle 104 is disposed in the main body recess 144 and is moveable between a shuttle first position, as illustrated in FIG. 6, and a shuttle second position, as illustrated in FIG. 7.

The shuttle recess 182 is disposed relatively central to the upper projection 184. The shuttle recess 182 is configured to receive a portion of a gun. The first shuttle passageway 186 has a first central axis that extends within the first main body shuttle passageway 146. The second shuttle passageway 188 has a second central axis that extends within the second shuttle passageway 188. The first shuttle passageway 186 has a third width 187 that is less than the first width 147 and the second shuttle passageway 188 has a fourth width 189 that is the same as the third width 187 and less than the second width 149.

The plurality of shuttle projections 192 are disposed on a side portion 194 of the shuttle 104 that is configured to be disposed in the main body recess 144. The plurality of shuttle projections 192 are configured to mate with the main body recess projections 152 to maintain the shuttle 104 within the main body recess 144. The shuttle spring 106 is disposed between the shuttle 104 and the main body 102. The shuttle spring 106 is configured to apply pressure to the shuttle 104 against the actuator 108. In the illustrated embodiment, the shuttle spring 106 is disposed between the shuttle 104 and the second end 134. In the illustrated embodiment, the shuttle 104 has +/−0.100 inches of travel within the main body recess 144 toward the first end 132 and the second end 134. Although the illustrated shuttle 104 has been described as having +/−0.100 inches of travel within the main body recess 144, a shuttle can travel within a main body recess any suitable distance. When the shuttle 104 is disposed within the main body recess 144, and during use, the first pin 110 is disposed through the first main body shuttle passageway 146, the second main body shuttle passageway 148, the first shuttle passageway 186, the second shuttle passageway 188, and through a portion of the upper receiver of a gun.

The first cap 120 is disposed over a first portion 121 of the shuttle 104 and attached to the main body 102 by a plurality of fasteners 125. The second cap 122 is disposed over a second portion 123 of the shuttle 104 and attached to the main boy by a plurality of fasteners 127. The third cap 124 is disposed under a portion of the second pin 112 and adjacent to the second pin 112. The third cap 124 is attached to the main body by a plurality of fasteners 129. The first cap 120, the second cap 122, and the third cap 124 can be made from any desired materials. In the illustrated embodiment, the main body 102 is formed of a first material and the first cap 120, the second cap 122, and the third cap 124 are formed of a second material (e.g., Delrin, also known as polyoxymethylene (POM)) that is different than the first material. Use of the second material prevents a gun from being scratched when securing the gun to the gun vise 100. The upper projection 184 of the shuttle 104 is disposed between the first cap 120 and the second cap 122.

The actuator 108 is moveable between an actuator first position, as illustrated in FIG. 6, and an actuator second position, as illustrated in FIG. 7. The actuator 108 has a threaded rod 196 disposed through the actuator passageway 150 and within the actuator recess 190, which is threaded to mate with the threaded rod 196. When the actuator 108 is moved between its actuator first position and its actuator second position, the shuttle 104 moves between its shuttle first position, as illustrated in FIG. 6, and its shuttle second position, as seen in FIG. 7. Movement of the shuttle 104 from the shuttle first position to the shuttle second position allows tension to be applied to a gun to maintain the position of the gun during use. The actuator 108 is configured to apply tension to a gun between the first pin 110 and the second pin 112. Alternatively, movement of the shuttle 104 from the shuttle second position to the shuttle first position allows pressure to be applied to a gun to maintain the position of the gun during use. The actuator 108 is configured to apply pressure to a gun between the first pin 110 and the second pin 112.

The barrel slot key 114 has a rack 198, a platform 200, a barrel slot key shaft 202, a barrel slot key first diameter 201, a barrel slot key second diameter 203, and a platform cutout 204. The barrel slot key 114 is made of hardened stainless steel and allows a user to torque muzzle devices in the gun vise 100. The barrel slot key 114 is removably disposed within the barrel slot key recess 158, which allows the barrel slot key 114 to be removed in order to secure a gun to the gun vise 100 upside down using the first picatinny rail clamp 116 and the second picatinny rail clamp 118. The rack 198 is disposed on the platform 200. The rack 198 is configured to receive a portion of a gun. The barrel slot key first diameter 201 is measured along the platform 200 and is substantially equal to the first diameter 157 of the barrel slot key recess 158. When the barrel slot key 114 is disposed within the main body 102, the platform 200 is disposed on the shoulder 172. The platform 200 includes the platform cutout 204 that is configured to receive a stud 206. The stud 206 is disposed within a recess of the main body 102 and is configured to be received by the platform cutout 204. The stud 206 prevents the barrel slot key 114 from rotating during use and while the barrel slot key 114 is disposed within the main body 102. The barrel slot key shaft 202 extends from the platform 200 and is configured to be disposed within the barrel slot key recess 158. The barrel slot key shaft 202 includes the barrel slot key second diameter 203 that is substantially the same as the second diameter 159 of the barrel slot key recess 158.

The first picatinny rail clamp 116 includes a first picatinny rail main body 207, a first picatinny rail spring 208, a first washer 210, and a first fastener 212. The first picatinny rail clamp 116 is disposed within the first picatinny rail clamp recess 160. The first picatinny rail spring 208 is disposed within the first picatinny rail clamp recess 160 between the main body 102 and the first picatinny rail main body 207. The first picatinny rail clamp 116 is secured within the first picatinny rail clamp recess 160 by the first washer 210 and the first fastener 212. The first picatinny rail clamp 116 is moveable between a first picatinny rail clamp first position, as illustrated in FIG. 6, and a first picatinny rail clamp second position, as illustrated in FIG. 7. The first picatinny rail clamp 116 is moved between the first picatinny rail clamp first position and the first picatinny rail clamp second position by adjusting the first fastener 212.

The second picatinny rail clamp 118 includes a second picatinny rail main body 213, a second picatinny rail spring 214, a second washer 216, and a second fastener 218. The second picatinny rail clamp 118 is disposed within the second picatinny rail clamp recess 162. The second picatinny rail spring 214 is disposed within the second picatinny rail clamp recess 162 between the main body 102 and the second picatinny rail main body 213. The second picatinny rail clamp 118 is secured within the second picatinny rail clamp recess 162 by the second washer 216 and the second fastener 218. The second picatinny rail clamp 118 is moveable between a second picatinny rail clamp first position, as illustrated in FIG. 7, and a second picatinny rail clamp second position, as illustrated in FIG. 6. The second picatinny rail clamp 118 is moved between the second picatinny rail clamp first position and the second picatinny rail clamp second position by adjusting the second fastener 218. The first picatinny rail clamp 116 and the second picatinny rail clamp 118 provide a mechanism for mounting a gun in the upside down position on the main body 102 such that a user can work on the bottom 142 of the upper receiver securely.

In the illustrated embodiment, the gun vise 100 has a first cutout 220 and a second cutout 222. The first cutout 220 is disposed on the first side 136 and extends from the bottom 142 toward the top 140 and from the first side 136 toward the second side 138. The second cutout 222 is disposed on the second side 138 and extends from the bottom 142 toward the top 140 and from the second side 138 toward the first side 136. The first cutout 220 and the second cutout 222 provide structure for receiving a clamp to secure the gun vise 100 to another object, such as a table. The first cutout 220 and the second cutout 222 create a shelf that is configured to receive the clamp (e.g., table clamp) and level the gun vise such that it is parallel to a table on which the clamp is disposed.

Various methods of using a gun vise, such as an embodiment described herein, are described. While these methods are shown and described as a series of acts, it is to be understood and appreciated that the methods are not limited by the order of acts, as some acts may in accordance with these methods, occur in the order shown and/or described, in different orders, concurrently with other acts described herein, and/or be omitted.

A method of using a gun vise includes the following steps. A step includes placing a first portion of a gun (e.g., receiver of a gun) between a first receiver projection and a second receiver projection. Another step includes inserting a second pin through the first receiver projection, the first portion of the gun, and the second receiver projection. Another step includes disposing a second portion of a gun (e.g., handle of the gun) within a shuttle recess. Another step includes inserting a first pin through a first main body shuttle passageway, a first shuttle passageway, the second portion of the gun, a second shuttle passageway, and a second main body shuttle passageway. Another step includes actuating the actuator to apply tension or pressure to the gun and between the first pin and the second pin. This method of using a gun vise can be performed by having a barrel slot key disposed in a barrel slot key recess. In alternative embodiments, the barrel slot key can be removed from the barrel slot key recess prior to performing the above-mentioned steps.

Another method of using a gun vise includes the following steps. A step includes removing a barrel slot key from a main body. Another step includes adjusting a first fastener of a first picatinny rail clamp and a second fastener of a second picatinny rail clamp. Another step includes disposing a top side of a receiver of a gun between the first picatinny rail clamp, the second picatinny rail clamp, and an elongated rail. Another step includes adjusting the first fastener and the second fastener to secure the gun between the first picatinny rail clamp, the second picatinny rail clamp, and the elongated rail.

Those with ordinary skill in the art will appreciate that various modifications and alternatives for the described and illustrated examples can be developed in light of the overall teachings of the disclosure, and that the various elements and features of one example described and illustrated herein can be combined with various elements and features of another example without departing from the scope of the invention. Accordingly, the particular arrangement of elements disclosed herein have been selected by the inventor(s) simply to describe and illustrate examples of the invention and are not intended to limit the scope of the invention or its protection, which is to be given the full breadth of the appended claims and any and all equivalents thereof.

What is claimed is:

1. A gun vise comprising:

a main body having a first end, a second end, a main body recess, a first main body shuttle passageway, a second main body shuttle passageway, and a actuator passageway, the first main body shuttle passageway extending through the main body and to the main body recess, the second main body shuttle passageway extending through the main body and to the main body recess, the actuator passageway extending from the first end to the main body recess;

a shuttle disposed in the main body recess and moveable between a shuttle first position and a shuttle second position, the shuttle having a shuttle recess, a first shuttle passageway, a second shuttle passageway, and an actuator recess, the first shuttle passageway having a first central axis that extends within the first main body shuttle passageway, the second shuttle passageway having a second central axis that extends within the main body second shuttle passageway; and an actuator moveable between an actuator first position and an actuator second position, the actuator having a rod disposed through the actuator passageway and within the actuator recess, movement of the actuator between the actuator first position and the actuator second position moving the shuttle between the shuttle first position and the shuttle second position.

2. The gun vise of claim 1, wherein the main body has a plurality of main body recess projections disposed within the main body recess; and wherein the shuttle has a plurality of shuttle projections that mate with the main body recess projections to maintain the shuttle within the main body recess.

3. The gun vise of claim 1, wherein the main body has a first receiver projection, a second receiver projection, a first receiver projection passageway, and a second receiver projection passageway, the first receiver projection and the second receiver projection disposed at the second end, the first receiver projection passageway extending through the first receiver projection, the second receiver projection passageway extending through the second receiver projection.

4. The gun vise of claim 3, further comprising a first pin disposed through the first receiver projection passageway and the second receiver projection passageway.

5. The gun vise of claim 1, wherein the main body has a barrel slot key recess disposed between the main body recess and the second end; and further comprising a barrel slot key removably disposed within the barrel slot key recess, the barrel slot key having a rack.

6. The gun vise of claim 5, wherein the rack is configured to receive a portion of a gun.

7. The gun vise of claim 1, wherein the main body has a barrel slot key recess, a first picatinny rail clamp recess and a second picatinny rail clamp recess, the first picatinny rail clamp recess and the second picatinny rail clamp recess extending into the main body and disposed between the barrel slot key recess and the second end;

further comprising a first picatinny rail clamp disposed within the first picatinny rail clamp recess, the first picatinny rail clamp moveable between a first picatinny rail clamp first position and a first picatinny rail clamp second position; and further comprising a second picatinny rail clamp disposed within the second picatinny rail clamp recess, the second picatinny rail clamp moveable between a second picatinny rail clamp first position and a second picatinny rail clamp second position.

8. The gun vise of claim 7, further comprising a first picatinny rail clamp spring disposed between the first picatinny rail clamp and the main body; and further comprising a second picatinny rail clamp spring disposed between the second picatinny rail clamp and the main body.

9. The gun vise of claim 7, wherein the main body has a lengthwise axis and an elongated rail, the elongated rail disposed between the first end and the second end and aligned relative to the lengthwise axis with the first picatinny rail clamp recess and the second picatinny rail clamp recess.

10. The gun vise of claim 1, further comprising a shuttle spring disposed between the shuttle and the main body.

11. The gun vise of claim 1, further comprising a first cap disposed over a first portion of the shuttle and attached to the main body.

12. The gun vise of claim 11, further comprising a second cap disposed over a second portion of the shuttle and attached to the main body.

13. The gun vise of claim 12, wherein the shuttle defines upper projection disposed between the first cap and the second cap.

14. The gun vise of claim 1, further comprising a first pin disposed through the first main body shuttle passageway, the second main body shuttle passageway, the shuttle first passageway, and the shuttle second passageway.

15. The gun vise of claim 1, wherein the shuttle has +/−0.100" of travel.

16. The gun vise of claim 1, wherein the rod is threaded.

17. The gun vise of claim 1, wherein the shuttle recess is configured to receive a portion of a gun.

18. The gun vise of claim 1, wherein the first main body shuttle passageway has a first width;

the second main body shuttle passageway has a second width that is substantially equal to the first width;

the first shuttle passageway has a third width that is less than the second width; and the second shuttle passageway has a fourth width that is the same as the third width.

19. A gun vise comprising:

a main body having a first end, a second end, a main body recess, a first main body shuttle passageway, a second main body shuttle passageway, an actuator passageway, a plurality of main body recess projections disposed within the main body recess, and a barrel slot key recess disposed between the main body recess and the second end, the first main body shuttle passageway extending through the main body and to the main body recess, the second main body shuttle passageway extending through the main body and to the main body recess, the actuator passageway extending from the first end to the main body recess;

a shuttle disposed in the main body recess and moveable between a shuttle first position and a shuttle second position, the shuttle having a shuttle recess, a first shuttle passageway, a second shuttle passageway, an actuator recess, and a plurality of shuttle projections that mate with the main body recess projections to maintain the shuttle within the main body recess, the first shuttle passageway having a first central axis that extends within the first main body shuttle passageway, the second shuttle passageway having a second central axis that extends within the main body second shuttle passageway;

an actuator moveable between an actuator first position and an actuator second position, the actuator having a threaded rod disposed through the actuator passageway and within the actuator recess, movement of the actuator between the actuator first position and the actuator second position moving the shuttle between the shuttle first position and the shuttle second position; and a barrel slot key removably disposed within the barrel slot key recess, the barrel slot key having a rack configured to receive a portion of a gun.

20. A gun vise comprising:

a main body having a lengthwise axis, a first end, a second end, a main body recess, a first main body shuttle passageway, a second main body shuttle passageway, an actuator passageway, a plurality of main body recess projections disposed within the main body recess, a barrel slot key recess disposed between the main body recess and the second end, a first receiver projection, a second receiver projection, a first receiver projection passageway, a second receiver projection passageway, a first picatinny rail clamp recess, a second picatinny rail clamp recess, and an elongated rail, the first main body shuttle passageway extending through the main body and to the main body recess, the second main body shuttle passageway extending through the main body and to the main body recess, the actuator passageway extending from the first end to the main body recess, the first receiver projection and the second receiver projection disposed at the second end, the first receiver projection passageway extending through the first receiver projection, the second receiver projection passageway extending through the second receiver projection, the first picatinny rail clamp recess and the second picatinny rail clamp recess extending into the main body and disposed between the barrel slot key recess and the second end, the elongated rail disposed between the first end and the second end and aligned relative to the lengthwise axis with the first picatinny rail clamp recess and the second picatinny rail clamp recess;

a shuttle disposed in the main body recess and moveable between a shuttle first position and a shuttle second position, the shuttle having a shuttle recess, a first shuttle passageway, a second shuttle passageway, an actuator recess, and a plurality of shuttle projections that mate with the main body recess projections to maintain the shuttle within the main body recess, the shuttle recess configured to receive a portion of a gun, the first shuttle passageway having a first central axis that extends within the first main body shuttle passageway, the second shuttle passageway having a second central axis that extends within the main body second shuttle passageway;

a shuttle spring disposed between the shuttle and the main body;

a first cap disposed over a first portion of the shuttle and attached to the main body;

a second cap disposed over a second portion of the shuttle and attached to the main body;

a first pin disposed through the first main body shuttle passageway, the second main body shuttle passageway, the shuttle first passageway, and the shuttle second passageway;

a second pin disposed through the first receiver passageway and the second receiver passageway;

an actuator moveable between an actuator first position and an actuator second position, the actuator having a threaded rod disposed through the actuator passageway and within the actuator recess, movement of the actuator between the actuator first position and the actuator second position moving the shuttle between the shuttle first position and the shuttle second position;

a barrel slot key removably disposed within the barrel slot key recess, the barrel slot key having a rack configured to receive a portion of a gun;

a first picatinny rail clamp disposed within the first picatinny rail clamp recess, the first picatinny rail clamp moveable between a first picatinny rail clamp first position and a first picatinny rail clamp second position; and a second picatinny rail clamp disposed within the second picatinny rail clamp recess, the second picatinny rail clamp moveable between a second picatinny rail clamp first position and a second picatinny rail clamp second position.

* * * * *